US009293115B2

(12) United States Patent
Furumoto et al.

(10) Patent No.: US 9,293,115 B2
(45) Date of Patent: Mar. 22, 2016

(54) DISPLAY APPARATUS AND CONTROL METHOD THEREOF

(71) Applicant: CANON KABUSHIKI KAISHA, Tokyo (JP)

(72) Inventors: Yoshihisa Furumoto, Machida (JP); Takeshi Ikeda, Ebina (JP); Takushi Kimura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 162 days.

(21) Appl. No.: 13/826,893

(22) Filed: Mar. 14, 2013

(65) Prior Publication Data

US 2013/0265337 A1 Oct. 10, 2013

(30) Foreign Application Priority Data

Apr. 9, 2012 (JP) ..... 2012-088329

(51) Int. Cl.
*G09G 5/10* (2006.01)
*G09G 3/34* (2006.01)

(52) U.S. Cl.
CPC ..... *G09G 5/10* (2013.01); *G09G 3/3426* (2013.01); *G09G 2320/0646* (2013.01); *G09G 2360/16* (2013.01)

(58) Field of Classification Search
CPC ..... G09G 5/10; G09G 3/3406; G09G 3/3426; G09G 2320/02; G09G 2320/0233; G09G 2320/0626; G09G 2320/0646; G09G 2320/066
See application file for complete search history.

(56) References Cited

U.S. PATENT DOCUMENTS

| | | | | |
|---|---|---|---|---|
| 8,525,934 | B2 * | 9/2013 | Okui et al. | 348/687 |
| 2009/0115720 | A1 * | 5/2009 | Inada et al. | 345/102 |

FOREIGN PATENT DOCUMENTS

| | | | |
|---|---|---|---|
| JP | 2000-321993 | A | 11/2000 |
| JP | 2002-099250 | A | 4/2002 |
| WO | 2009/096068 | A1 | 8/2009 |
| WO | 2009-096329 | A | 8/2009 |
| WO | 2012-114989 | A1 | 8/2012 |

OTHER PUBLICATIONS

The above foreign patent documents were the Apr. 21, 2015 Japanese Office Action, which is enclosed without an English Translation, that issued in Japanese Patent Application No. 2012-088329.

* cited by examiner

*Primary Examiner* — Charles Hicks
(74) *Attorney, Agent, or Firm* — Cowan, Liebowitz & Latman, P.C.

(57) ABSTRACT

A display apparatus according to the present invention comprises: an acquisition unit that acquires, for each of division regions, brightness information; a decision unit that decides light emission brightness for each of the division regions; a light emitting unit; and a display panel, wherein the decision unit sets light emission brightness of a division region, in which a displayed image does not include a predetermined region, at light emission brightness according to brightness information of the division region, and sets light emission brightness of a division region, in which a displayed image includes the predetermined region, at light emission brightness lower than the light emission brightness according to brightness information of the division region.

20 Claims, 14 Drawing Sheets

FIG. 5

| | | | | | | |
|---|---|---|---|---|---|---|
| 30 | 250 | 30 | 30 | 30 | 200 | 30 |
| 30 | 30 | 250 | 30 | 30 | 30 | 30 |
| 30 | 30 | 30 | 30 | 30 | 30 | 30 |
| 30 | 30 | 30 | 255 | 30 | 96 | 96 |
| 30 | 240 | 255 | 255 | 255 | 96 | 96 |

MAXIMUM PIXEL VALUES
OF RESPECTIVE DIVISION REGIONS

FIG. 6

| | | | | | | |
|---|---|---|---|---|---|---|
| 30 | 31 | 30 | 0 | 0 | 25 | 0 |
| 30 | 30 | 31 | 0 | 0 | 0 | 0 |
| 30 | 30 | 30 | 0 | 0 | 0 | 0 |
| 30 | 30 | 30 | 180 | 0 | 0 | 0 |
| 30 | 220 | 120 | 170 | 100 | 0 | 0 |

AVERAGE PIXEL VALUES
OF RESPECTIVE DIVISION REGIONS

FIG. 7

| | | | | | | |
|---|---|---|---|---|---|---|
| 0 | 1 | 0 | 0 | 0 | 1 | 0 |
| 0 | 0 | 1 | 0 | 0 | 0 | 0 |
| 0 | 0 | 0 | 0 | 0 | 0 | 0 |
| 0 | 0 | 0 | 50 | 0 | 0 | 0 |
| 0 | 80 | 30 | 45 | 20 | 0 | 0 |

BRIGHT PORTION AREA RATIOS
OF RESPECTIVE DIVISION REGIONS [%]

| | | | | | | |
|---|---|---|---|---|---|---|
| 12 | 98 | 12 | 12 | 12 | 78 | 12 |
| 12 | 12 | 98 | 12 | 12 | 12 | 12 |
| 12 | 12 | 12 | 12 | 12 | 12 | 12 |
| 12 | 12 | 12 | 100 | 12 | 38 | 38 |
| 12 | 94 | 100 | 100 | 100 | 38 | 38 |

BACKLIGHT CONTROL VALUES
OF RESPECTIVE DIVISION REGIONS [%]
(BEFORE CORRECTION)

DIVISION REGION A
DIVISION REGION B
DIVISION REGION C

| | | | | | | |
|---|---|---|---|---|---|---|
| 0 | 1 | 0 | 0 | 0 | 1 | 0 |
| 0 | 0 | 1 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

DETERMINATION RESULTS OF
RESPECTIVE DIVISION REGIONS
IN S104

CORRECTED VALUES

| | | | | | | |
|---|---|---|---|---|---|---|
| 12 | 20 | 12 | 12 | 12 | 16 | 12 |
| 12 | 12 | 20 | 12 | 12 | 12 | 12 |
| 12 | 12 | 12 | 12 | 12 | 12 | 12 |
| 12 | 12 | 12 | 100 | 12 | 38 | 38 |
| 12 | 94 | 100 | 100 | 100 | 38 | 38 |

BACKLIGHT CONTROL VALUES
OF RESPECTIVE DIVISION REGIONS [%]
(AFTER CORRECTION)

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

Heretofore, in liquid crystal display apparatuses, there is a technique of dividing a screen into a plurality of division regions, and controlling, for each of the division regions, transmittance of a liquid crystal panel (liquid crystal elements that the liquid crystal panel has) and light emission brightness of a backlight (a light emitting unit) in accordance with a characteristic value of a pixel value of an image displayed in the division region (Japanese Patent Application Laid-open No. 2002-99250). By employing such a technique, it is possible to suppress a misadjusted black level of a dark portion of the image, and eventually improve contrast.

Specifically, in display apparatuses required to faithfully reproduce brightness (to maintain the brightness of an image), there is a technique of controlling transmittance of a liquid crystal panel and light emission brightness of a backlight of a division region in accordance with a maximum pixel value of an image displayed in the division region.

However, when the brightness of the image is controlled to be maintained, in a case where small area and high brightness regions (regions with a small area and high brightness) exist in a dark portion of the image as shown in FIG. 3, misadjusted black levels occur in the dark portion. Specifically, in the dark portion, the light emission brightness of the backlight in division regions, in which portions where the small area and high brightness regions exist are displayed, is set to be higher than the light emission brightness of the backlight in division regions, in which portions where the small area and high brightness regions in the dark portion do not exist are displayed. As a result, as shown in FIG. 14, in the dark portion, the portions where the small area and high brightness regions exist are more brightly displayed than the other portions (that is, misadjusted black levels occur).

A conventional technique for solving the aforementioned problem is disclosed in WO 2009/096329, for example. Specifically, WO 2009/096329 discloses that improvement of black expression is attained by determining a scene from an average brightness value of the whole screen and a shape of a histogram, and lowering the light emission brightness of the backlight and reducing an important degree of white portions in a case of a scene with an extremely small ratio of the white portions to the whole screen.

However, in the technique disclosed in WO 2009/096329, the light emission brightness of the backlight of the whole screen is controlled. Due to this, when trying to prevent the aforementioned misadjusted black levels, the brightness on the screen is totally lowered, and faithfulness of the brightness is reduced.

SUMMARY OF THE INVENTION

The present invention provides a technique enabling suppression of lowering of brightness of a whole screen and occurrence of misadjusted black levels in a display apparatus, attaining improvement of contrast of a displayed image by controlling light emission brightness of a light emitting unit for each division region.

A display apparatus according to the present invention comprises:

an acquisition unit that acquires, for each of division regions constituting a region of a screen, brightness information including a maximum pixel value and an average pixel value of an image displayed in the corresponding division region;

a first determination unit that determines, for each of division regions, whether the corresponding division region is a division region including a predetermined region, on the basis of the brightness information acquired by the acquisition unit;

a second determination unit that determines light emission brightness for each of the division regions on the basis of the brightness information acquired by the acquisition unit and the determination result by the first determination unit;

a light emitting unit that emits, for each of the division regions, light at the light emission brightness of the corresponding division region determined by the second determination unit; and a display panel that displays an image by transmitting the light from the light emitting unit at transmittance based on an input image data, wherein the first determination unit determines that each of a division region, of which the average pixel value is greater than a first threshold value, and a division region, in which a value obtained by deducting the average pixel value from the maximum pixel value is smaller than a second threshold value, is a division region not including the predetermined region, and determines that a division region, of which the average pixel value is not greater than the first threshold value and in which the value obtained by deducting the average pixel value from the maximum pixel value is not smaller than the second threshold value, is the division region including the predetermined region, and the second determination unit sets light emission brightness of the division region not including the predetermined region at light emission brightness according to the maximum pixel value of the division region, and sets light emission brightness of the division region including the predetermined region at light emission brightness lower than the light emission brightness according to the maximum pixel value of the division region.

A control method according to the present invention is a control method of a display apparatus having a light emitting unit, and a display panel that displays an image by transmitting light from the light emitting unit at transmittance based on an input image data.

The control method of a display apparatus comprises:

an acquisition step of acquiring, for each of division regions constituting a region of a screen, brightness information including a maximum pixel value and an average pixel value of an image displayed in the corresponding division region;

a first determination step of determining, for each of division regions, whether the corresponding division region is a division region including a predetermined region, on the basis of the brightness information acquired by the acquisition step;

a second determination step of determining light emission brightness for each of the division regions on the basis of the brightness information acquired by the acquisition step and the determination result by the first determination step; and a controlling step of controlling the light emitting unit so that the light emitting unit emits, for each of the division regions, light at the light emission brightness of the corresponding division region determined by the second determination step, wherein in the first determination step, it is determined that each of a division region, of which the average pixel value is greater than a first threshold value, and a division region, in which a value obtained by deducting the average pixel value from the maximum pixel value is smaller than a second threshold value, is a division region not including the predetermined region, and is determined that a division region, of which the average pixel value is not greater than the first threshold value and in which the value obtained by deducting the average pixel value from the maximum pixel value is not smaller than the second threshold value, is the division region including the predetermined region, and in the second determination step, light emission brightness of the division region not including the predetermined region is set at light emission brightness according to the maximum pixel value information of the division region, and light emission brightness of the division region including the predetermined region is set at light emission brightness lower than the light emission brightness according to the maximum pixel value of the division region.

According to the present invention, lowering of brightness of a whole screen and occurrence of misadjusted black levels can be suppressed in a display apparatus, attaining improvement of contrast of a displayed image by controlling light emission brightness of a light emitting unit for each division region.

Further features of the present invention will become apparent from the following description of exemplary embodiments with reference to the attached drawings.

BRIEF DESCRIPTION OF THE DRAWINGS

FIG. 5 shows an example of maximum pixel values of the respective division regions according to the first practical example;

FIG. 6 shows an example of average pixel values of the respective division regions according to the first practical example;

FIG. 7 shows an example of bright portion area ratios of the respective division regions according to the first practical example;

DESCRIPTION OF THE EMBODIMENTS

First Practical Example

Hereinafter, a display apparatus according to a first practical example of the present invention and a control method of the same will be described.

Figure 1:
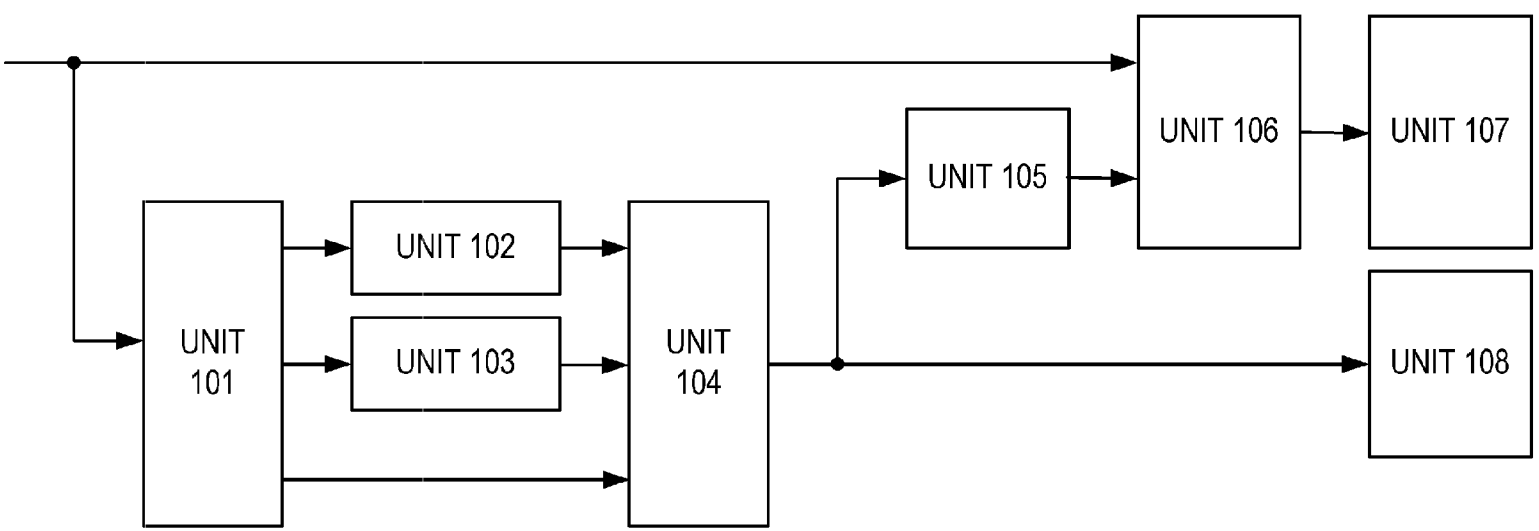
FIG. 1 shows an example of a function configuration of a display apparatus according to a first practical example.

FIG. 1 is a block diagram showing an example of a function configuration of the display apparatus according to the present practical example. The display apparatus according to the present practical example has a characteristic value detection unit 101, a small area and high brightness region determination unit 102, a backlight control value decision unit 103, a backlight control value correction unit 104, an elongation rate decision unit 105, an image correction unit 106, a liquid crystal panel unit 107, a backlight unit 108, and the like. While a liquid crystal display apparatus is hereinafter exemplified as the display apparatus, various display panels such as color filter based organic EL (system using organic EL light emitting elements and color filters) can be used. That is, as long as the display apparatus of the present invention is a display apparatus having a light emitting unit, and a display panel displaying an image by transmitting light from the light emitting unit at transmittance based on an input image data (signal), any display apparatus may be employed.

The input image signal (image signal input in the display apparatus; input image) is input in the characteristic value detection unit 101. The characteristic value detection unit 101 detects, for respective division regions constituting a region of a screen (for respective division regions obtained by dividing the screen (the displayed image)), characteristic values representing the levels of brightness of images displayed in the respective division regions as the characteristic values (brightness information) of the images (partial images of the input images) displayed in the division regions. Specifically, the characteristic value detection unit 101 detects maximum pixel values (maximum values of pixel values) of the images displayed in the respective division regions as the characteristic values. The characteristic value detection unit 101 also detects average pixel values (average values of the pixel values) of the images displayed in the respective division regions. Additionally, the characteristic value detection unit 101 detects (calculates) a ratio of pixels with pixel values equal to or greater than a predetermined value (bright portion area ratio) to total pixels in the image displayed in each of the division regions.

The characteristic values (maximum pixel values), the average pixel values, and the bright portion area ratios may be externally acquired.

The small area and high brightness region determination unit 102 determines whether or not the images displayed in the division regions each include a predetermined region (a small area and high brightness region), for the respective division regions (small area and high brightness region determination). Specifically, the small area and high brightness region determination unit 102 makes a small area and high brightness region determination for the respective division regions on the basis of detection results of the characteristic value detection unit 101. The small area and high brightness region is a region with a small area and high brightness. Here, the "small area" means that the total area of a region with high brightness in each division region is small. Specifically, the small area and high brightness region is a region with an area equal to or lower than an area threshold value and with brightness equal to or lower than a brightness threshold value. The area threshold value and the brightness threshold value each may be a value previously determined by a manufacturer or a value set (changed) by a user. Additionally, the first threshold value and the brightness threshold value each may be automatically determined in accordance with the type of the input image signal, average brightness or the like.

The backlight control value decision unit 103 and the backlight control value correction unit 104 each decide the light emission brightness for the respective division regions on the basis of the determination results of the small area and high brightness region determination unit 102, and the characteristic values detected by the characteristic value detection unit 101.

The backlight control value decision unit 103 obtains light emission brightness according to the characteristic values of the division regions for the respective division regions. In the present practical example, backlight control values representing the light emission brightness are obtained and output to the backlight control value correction unit 104. The backlight control value is a value linearly increasing with respect to the increase of the light emission brightness in the present practical example, but not limited to this. The backlight control value may be a value non-linearly increasing with respect to the increase of the light emission brightness.

The backlight control value correction unit 104 corrects the light emission brightness obtained by the backlight control value decision unit 103. In the present practical example, the backlight control value correction unit 104 corrects to lower the light emission brightness, which is obtained by the backlight control value decision unit 103, with respect to division regions, which are determined as including the small area and high brightness regions by the small area and high brightness region determination unit 102. Specifically, the backlight control value correction unit 104 corrects the backlight control values, which are obtained by the backlight control value decision unit 103, so as to lower the light emission brightness with respect to the division regions, which are determined as including the small area and high brightness regions, and outputs the corrected backlight control values. The backlight control value correction unit 104 does not correct the light emission brightness with respect to division regions, which are determined as not including the small area and high brightness regions. Specifically, the backlight control value correction unit 104 outputs the backlight control values, which are obtained by the backlight control value decision unit 103, with respect to the division regions, which are determined as not including the small area and high brightness regions, without any change (without correction).

Thus, in the present practical example, the light emission brightness of the division regions determined as not including the small area and high brightness regions is set as light emission brightness according to the characteristic values of the division regions. Additionally, the light emission brightness of the division regions determined as including the small area and high brightness regions is set as light emission brightness lower than the light emission brightness according to the characteristic values of the division regions.

The backlight control value decision unit 103 or the backlight control value correction unit 104 may calculate light emission brightness (backlight control values) by a predetermined arithmetic operation, or may select light emission brightness from among a plurality of predetermined values by using a predetermined table or the like.

The backlight unit 108 (light emitting unit) has a backlight and a backlight drive unit. As a light source of the backlight unit 108, for example, a light-emitting device such as a light emitting diode (LED) is used.

The backlight drive unit drives the backlight in accordance with backlight control values for the respective division regions, which are output from the backlight control value correction unit 104. Thus, the backlight is controlled so as to emit light at the light emission brightness of the division regions, which are decided, for the respective division regions.

The elongation rate decision unit 105 decides elongation rates on the basis of the light emission brightness, which are decided with respect to the division regions, for the respective division regions. Specifically, the elongation rates are decided for the respective division regions on the basis of the backlight control values of the division regions, which are output from the backlight control value correction unit 104. The elongation rate is a value multiplying a pixel value in order to suppress the brightness on the screen due to lowering of the light emission brightness of the backlight. For example, the larger the reduction amount of the backlight control value with respect to a reference value is, the larger the elongation rate is. Specifically, the elongation rate is an inverse of a lowering rate of the backlight control value with respect to a reference value. The elongation rate may be calculated by an arithmetic operation, or may be selected from among a plurality of predetermined values by using a predetermined table or the like.

The image correction unit 106 multiplies the respective pixel values of the images displayed in the division regions by the elongation rates of the division regions, which are decided by the elongation rate decision unit 105, for the respective division regions. Thus, the input image signal is corrected so as to suppress the brightness on the screen due to the lowering of the light emission brightness of the backlight. Additionally, in a case where corrected pixel values (values obtained by multiplying the pixel values by the elongation rates) are greater than a settable upper limit of pixel values, the image correction unit 106 limits the corrected pixel values to the settable upper limit of the pixel values.

The liquid crystal panel unit 107 has a liquid crystal panel and a liquid crystal drive unit.

The liquid crystal drive unit drives a plurality of liquid crystal elements, which the liquid crystal panel has, in accordance with an image signal (the input image signal multiplied by the elongation rates) output from the image correction unit 106. Specifically, the plurality of liquid crystal elements is driven such that an aperture ratio (transmittance) is a value according to the image signal.

The image is displayed on the screen by transmitting light from the backlight through the liquid crystal panel.

Figure 2:
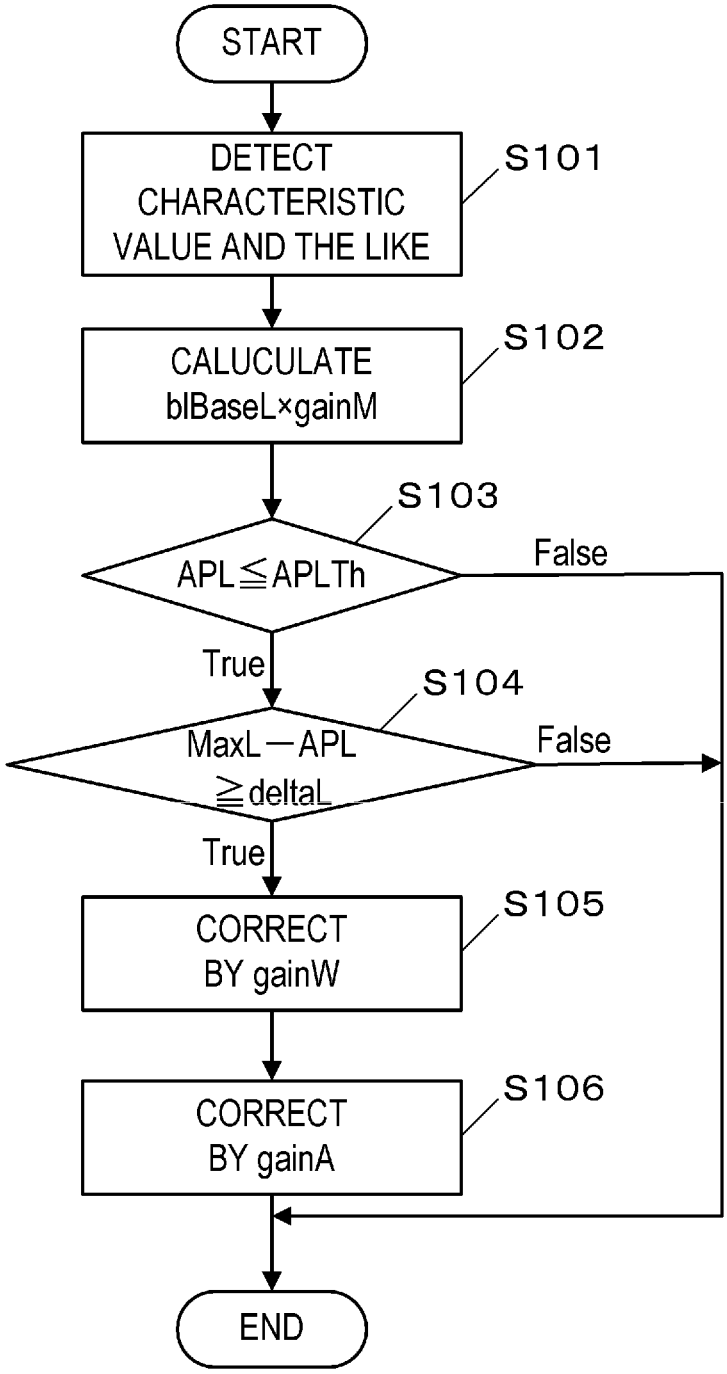
FIG. 2 shows an example of a processing flow of a display apparatus according to the first practical example.

A processing flow of the display apparatus according to the present practical example will be hereinafter described with reference to a flowchart of FIG. 2. FIG. 2 is a flowchart showing an example of the processing flow of the display apparatus according to the present practical example. The flowchart of FIG. 2 is performed repeatedly (or in a parallel manner) for the respective division regions.

Figure 3:
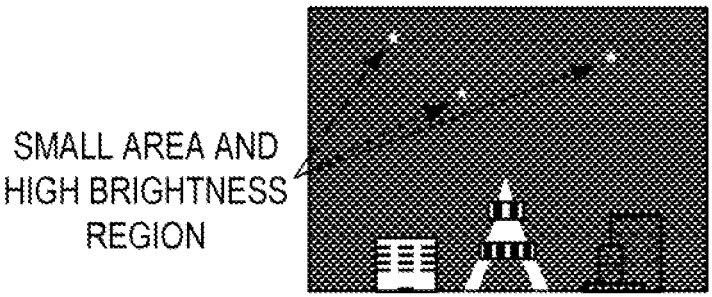
FIG. 3 shows an example of an input image according to the first practical example.

Hereinafter, an example of a case where the input image is an image of FIG. 3 will be described. The image of FIG. 3 is an image of a night view. In the case of the image of FIG. 3, for example, regions of stars can be the small area and high brightness regions.

Figure 4:
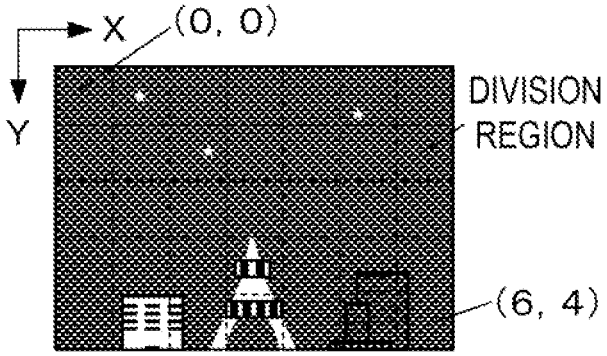
FIG. 4 shows an example of division regions according to the first practical example.

Hereinafter, it is assumed that division regions are set as shown in FIG. 4. The regions surrounded by broken lines of FIG. 4 are the division regions. While the screen is divided into a total of 35 division regions, which are 7 in a horizontal direction×5 in a vertical direction, in an example of FIG. 4, a divided method of the screen or the divided number of the screen is not limited to this. For example, the division regions may regions obtained by dividing the screen in strip shapes. The number of the division regions may be greater than or fewer than 35, for example, 30 or 40.

First, the characteristic value detection unit 101 detects, from an input image, a characteristic value (maximum pixel value), an average pixel value, and a bright portion area ratio of a division region to be processed (target division region) (S101). The maximum pixel values, the average pixel values, the bright portion area ratios of the respective division regions detected from the image of FIG. 3 are values shown in FIG. 5, FIG. 6, and FIG. 7, respectively. In FIGS. 5, 6, and 7, regions surrounded by solid lines are the division regions, and numerical values described in the division regions are values corresponding to the division regions (maximum pixel values, average pixel values, and bright portion area ratios).

Figures 8, 9, 10:
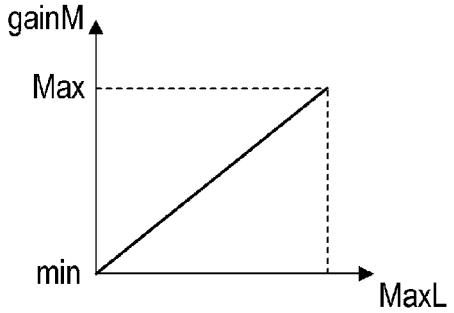
FIG. 8 shows an example of the relation between the maximum pixel value and the gainM according to the first practical example.
FIG. 9 shows an example of backlight control values before correction of the respective division regions according to the first practical example.
FIG. 10 shows an example of determination results of the respective division regions in S104.

Next, the backlight control value decision unit 103 calculates light emission brightness (backlight control value) of the target division region (S102). Specifically, the backlight control value decision unit 103 calculates the backlight control value by multiplying a reference value blBaseL of the backlight control value by a gain value gainM corresponding to a characteristic value of the target division region. The gain value gainM is a value linearly increasing with respect to the increase of the characteristic value (maximum pixel value MaxL) as shown in FIG. 8, for example. The gain value gainM may be a value non-linearly increasing with respect to the increase of the characteristic value. The gain value gainM may be a value continuously increasing with respect to the increase of the characteristic value, or may be a value increasing with respect to the increase of the characteristic value in stages.

FIG. 9 shows backlight control values of the respective division regions (values obtained in S102) in a case where the maximum pixel values of the respective division regions are the values of FIG. 5, the backlight control value is 100 [%] when the maximum pixel value is 255, and the backlight control value is 0 [%] when the maximum pixel value is 0.

Then, the small area and high brightness region determination unit 102 determines whether or not an average pixel value APL of the target division region is a threshold value APLTh or less (S103). In a case where the average pixel value APL of the target division region is the threshold value APLTh or less (S103: True), the process advances to S104. In a case where the average pixel value APL is high, there is a high possibility that the brightness of the image displayed in the target division region is totally high. In a case where the brightness of the image displayed in the target division region is totally high, even when a misadjusted black level occurs in the target division region, disturbance feeling caused by the misadjusted black level is small. In the present practical example, in a case where the average pixel value APL of the target division region is greater than the threshold value APLTh (S103: False), the small area and high brightness region determination unit 102 unconditionally determines that the image displayed in the target division region does not include the small area and high brightness region. Then, the backlight control value (value obtained in S102) of the target division region is not corrected, and this flow is terminated.

In S104, the small area and high brightness region determination unit 102 determines whether or not a value obtained by deducting the average pixel value APL from the maximum pixel value MaxL of the target division region is a threshold value detlaL or more. As the detlaL, for example, a sufficiently large value is set. A case where MaxL−APL≥detlaL holds means that pixels with sufficiently large pixel values are included in the image displayed in the target division region. Furthermore, the case where MaxL−APL≥detlaL holds means that the total area of the region of the aforementioned pixels with sufficiently large pixel values is sufficiently smaller than a residual area. In the present practical example, in the case where MaxL−APL≥detlaL holds (S104: True), the small area and high brightness region determination unit 102 determines that the image displayed in the target division region includes the small area and high brightness region. Then, the process advances to S105. In a case where MaxL−APL≥detlaL does not hold (S104: False), the small area and high brightness region determination unit 102 determines that the image displayed in the target division region does not include the small area and high brightness region. Then, the backlight control value of the target division region (value obtained in S102) is not corrected, and this flow is terminated.

The value of detlaL may be a fixed value, or may not be the fixed value. For example, detlaL may be changed in accordance with a value of MaxL such that the larger the value of Maxi, is, the larger the value of detlaL.

After S104, the process of S103 may be performed. The process of S103 may be omitted.

In a case where the small area and high brightness region determination unit 102 determines that the image displayed in the division region includes the small area and high brightness region, "1" is output as the determination result. Additionally, in a case where the small area and high brightness region determination unit 102 determines that the image displayed in the division region does not include the small area and high brightness region, "0" is output as the determination result.

FIG. 10 shows the determination results in S104 of the respective division regions in a case where the maximum pixel values, the average pixel values of the respective division regions are the values of FIG. 5, FIG. 6, respectively, and APLTh=50 and detlaL=160 are satisfied. In an example of FIG. 10, it is determined that images displayed in three division regions, that is, a division region A of a position (horizontal position X, vertical position Y)=(1, 0), a division region B of a position (2, 1), and a division region C of a position (5, 0) each include the small area and high brightness region. Then, it is determined that images displayed in residual division regions do not include the small area and high brightness region.

In S105, S106, the backlight control value correction unit 104 corrects the light emission brightness (backlight control value calculated in S102) of the division region determined as including the small area and high brightness region.

Specifically, in S105, the backlight control value correction unit 104 corrects the backlight control value by multiplying the backlight control value calculated in S102 by a gain value gainW corresponding to a bright portion area ratio Wb of the target division region.

Figure 11A:
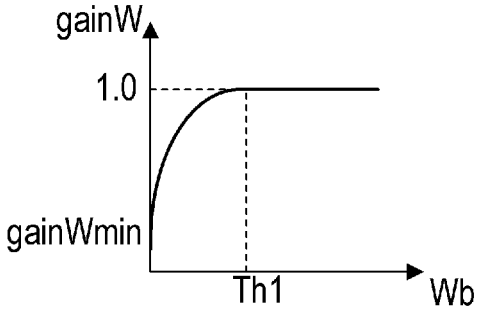
FIGS. 11A to 11C each show an example of the relation between Wb and gainW according to the first practical example.

The gain value gainW is a value non-linearly increasing with respect to the increase of the bright portion area ratio Wb as shown in FIG. 11A, for example.

A minimum value gainWmin of gainW is decided, for example, in accordance with targeted contrast. Specifically, assuming that in a panel where native contrast of liquid crystal is 500:1, the targeted contrast is three times that value, a lowest value of the light emission brightness of the backlight is set to ⅓ of the reference value, and hence gainWmin=⅓ is obtained. However, in a case where light emission brightness of the backlight is different between the division regions, lightness of the backlight in the division region is affected by light from the backlight in other division regions (leak light). Therefore, even when gainW=⅓ is set for only one division region, the contrast does not increase three-fold. In view of a diffusion coefficient of the light from the backlight, as gainWmin, a value smaller than ⅓ may be set.

Figure 11B:
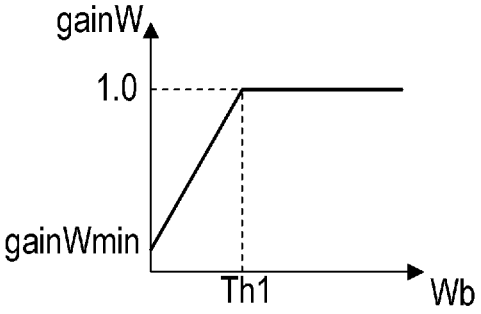
Figure 11C:
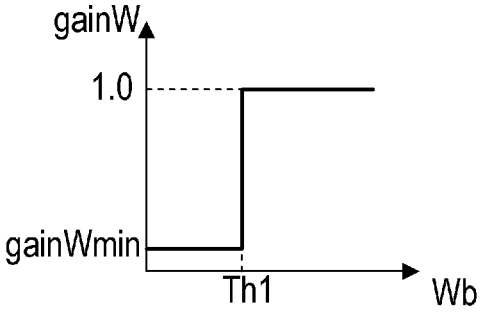

As shown in FIG. 11B, the gain value gainW may be a value linearly increasing with respect to the increase of the bright portion area ratio Wb. As shown in FIG. 11C, the gain value gainW may a fixed value. Additionally, the gain value gainW may be a value continuously increasing with respect to the increase of the bright portion area ratio Wb, or may be a value increasing with respect to the increase of the bright portion area ratio Wb in stages.

While it is assumed that gainW varies such that gainW is saturated by 1 in a case of Wb=Th1 in FIGS. 11A to 11C, gainW may be a value increasing with respect to the increase of Wb without being saturated.

The relation between the gain value gainW and the bright portion area ratio Wb may be selected from among a plurality of relations as shown in FIGS. 11A to 11C in accordance with a purpose (degree of suppression of a misadjusted black level or the like). For example, in a case where the degree of suppression of the misadjusted black level is "high", the relation of FIG. 11A is selected, in a case where the degree of suppression of the misadjusted black level is "medium", the relation of FIG. 11B is selected, and in a case where the degree of suppression of the misadjusted black level is "low", the relation of FIG. 11C is selected.

By the process of S105, the backlight control value calculated in S102 is reduced by a reduction amount (at a lowering rate), which is set such that the reduction amount (lowering rate) when the small area and high brightness region has a small area is larger (higher) than the reduction amount when the small area and high brightness region has a large area. That is, in the present practical example, the light emission brightness of the division region is decided such that a difference between the light emission brightness of the division region determined as including the small area and high brightness region and the light emission brightness according to the characteristic value of the division region when the small area and high brightness region has a small area is greater than the difference when the small area and high brightness region has a large area.

Here, the reason for using the bright portion area ratio is shown as follows.

The smaller the number of pixels of the small area and high brightness region displayed in the division region is, the more noticeable the misadjusted black level in the division region is. Therefore, the smaller the number of the pixels of the small area and high brightness region (the smaller the area) is, the larger the reduction amount of the backlight control value is made, thereby allowing the misadjusted black level to be made less noticeable. The bright portion area ratio is equivalent to the number of the pixels of the small area and high brightness region displayed in the division region, and hence the backlight control value is corrected by using the bright portion area ratio in the present practical example.

Figures 12, 13:
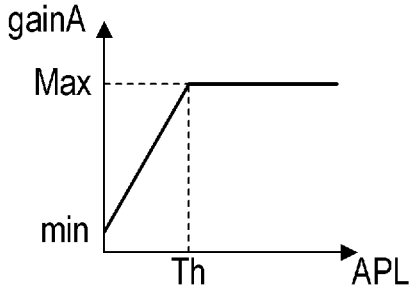
FIG. 12 shows an example of the relation between APL and gainA according to the first practical example.
FIG. 13 shows an example of backlight control values after correction of the respective division regions according to the first practical example.

In S106, the backlight control value correction unit 104 corrects the backlight control value by multiplying the backlight control value calculated in S105 by the gain value gainA corresponding to the average pixel value APL of the target division region. The gain value gainA is a value linearly increasing with respect to the increase of the average pixel value as shown in FIG. 12, for example. The gain value gainA may be a value non-linearly increasing with respect to the increase of the average pixel value. The gain value gainA may be a value continuously increasing with respect to the increase of the average pixel value, or may be a value increasing in stages. While it is assumed that gainA varies such that gainA is saturated by 1 in a case of APL=Th2 in FIG. 12, gainA may be a value increasing with respect to the increase of APL without being saturated.

By the process of S106, the backlight control value calculated in S105 is reduced by a reduction amount (at a lowering rate), which is set such that the reduction amount (lowering rate) when the average pixel value is small is larger (higher) than the reduction amount when the average pixel value is large. That is, in the present practical example, the light emission brightness of the division region is decided such that a difference between the light emission brightness of the division region determined as including the small area and high brightness region and the light emission brightness according to the characteristic value of the division region when the average pixel value of the image displayed in the division region is small is greater than the difference when the average pixel value is large.

The reason for using the average pixel value is shown as follows.

The smaller the pixel value of a region other than the small area and high brightness region in the image displayed in the division region is, the more noticeable the misadjusted black level in the division region is. This is because the backlight control value becomes a value unsuitable for the region other than the small area and high brightness region by the influence of the pixel value of the small area and high brightness region. It is considered that the pixel value of the region other than the small area and high brightness region when the average pixel value is small is smaller than that when the average pixel value is large. Therefore, the smaller the average pixel value is, the larger the reduction amount of the backlight control value is made, thereby allowing the misadjusted black level to be made less noticeable. In the present practical example, the backlight control value is corrected by using the average pixel value from such a reason.

FIG. 13 shows corrected backlight control value (values obtained in S106) of the respective division regions in a case where the determination results in S104 of the respective division regions are determination results shown in FIG. 10, and the backlight control values (values obtained in S102) before correction of the respective division regions are values shown in FIG. 9. As shown in FIG. 9, backlight control values before correction of the division regions A to C determined as including the small area and high brightness regions are 1. FIG. 13 shows an example of a case where gainW×gainA corresponding to the backlight control value "1" is 0.2.

The effects expected by a configuration of the present practical example will be described.

Figure 14:
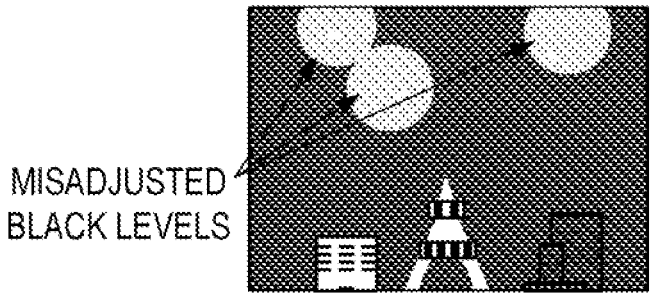
FIG. 14 shows an example of the problem of a conventional technique.

In a conventional configuration, light emission brightness according to characteristic values is set for the respective division regions. That is, in the conventional configuration, in a case where the image of FIG. 3 is input, a backlight is controlled by the backlight control values shown in FIG. 9. In FIG. 9, the backlight control values of the division regions A to C including the small area and high brightness regions are large. Therefore, as shown in FIG. 14, the noticeable misadjusted black levels occur on portions corresponding to the division regions A to C.

Figure 15:
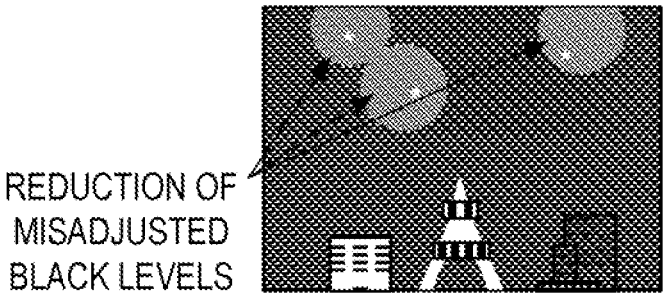
FIG. 15 shows an example of an effect of the present invention.

On the other hand, in the present practical example, the backlight control values are values shown in FIG. 13. Specifically, the backlight control values of the division regions A to C are lower than the values of FIG. 9. Thus, in dark portions of the image, a difference of the light emission brightness between the division regions, in which the portions where the small area and high brightness regions exist are displayed, and the division regions, in which the portions where the small area and high brightness regions do not exist are displayed is reduced. As a result, as shown in FIG. 15, the misadjusted black levels occurring on the portions corresponding to the division regions A to C can be reduced. Additionally, light emission brightness of regions other than the division regions A to C is the light emission brightness according to the characteristic values, and hence the reduction of the brightness of the screen can be suppressed.

As described above, according to the present practical example, the light emission brightness of the division regions determined as not including the small area and high brightness regions is the light emission brightness according to the characteristic values of the division regions. Then, the light emission brightness of the division regions determined as including the small area and high brightness regions is the light emission brightness lower than the light emission brightness according to the characteristic values of the division regions. Consequently, it is possible to suppress lowering of brightness of a whole screen and occurrence of misadjusted black levels in the display apparatus attaining improvement of contrast of the displayed image by controlling the light emission brightness of the backlight for the respective division regions.

Final light emission brightness for the respective division regions may be decided by correcting light emission brightness obtained on the basis of the characteristic values for the respective division regions (light emission brightness decided through the processing flow of FIG. 2; backlight control values of FIG. 13) so as to reduce variation by filtering or the like. Consequently, it is possible to suppress occurrence of a halo due to the difference of the light emission brightness between the division regions. Additionally, even in a case where control of the light emission brightness of the backlight is delayed by several frames, when a moving image where a bright object moves is displayed, brightness of the object can be inhibited from becoming low.

While with respect to the division region determined as including the small area and high brightness region, the light emission brightness according to the characteristic value of the division region is obtained, and thereafter the obtained value is corrected in the present practical example, the present invention is not limited to this configuration. With respect to the division region determined as including the small area and high brightness region, the light emission brightness according to the characteristic value may not be obtained, and the light emission brightness lower than the light emission brightness may be obtained.

While the light emission brightness of the division region determined as including the small area and high brightness region is decided on the basis of the average pixel value and the area of the small area and high brightness region in the present practical example, the present invention is not limited to this configuration. As long as a value lower than the light emission brightness according to the characteristic value is decided as the light emission brightness of the division region determined as including the small area and high brightness region, any light emission brightness may be decided. For example, the light emission brightness may be determined only by performing the process of one of S105 and S106. Light emission brightness, which is obtained by reducing the light emission brightness according to the characteristic value of the division region determined as including the small area and high brightness region at a predetermined rate, may be decided as the light emission brightness of the division region without consideration of the area or the average pixel value.

While the characteristic value is the maximum pixel value in the present practical example, the characteristic value is not limited to the maximum pixel value. For example, the characteristic value may be a value depending on the maximum pixel value. Specifically, the characteristic value may be an average pixel value of the image displayed in the division region. In a case where the characteristic value is such a characteristic value, effects equivalent to the aforementioned effects can be obtained by using the configuration of the present practical example.

Second Practical Example

Hereinafter, a display apparatus according to a second practical example of the present invention and a control method of the same will be described.

Figure 16:
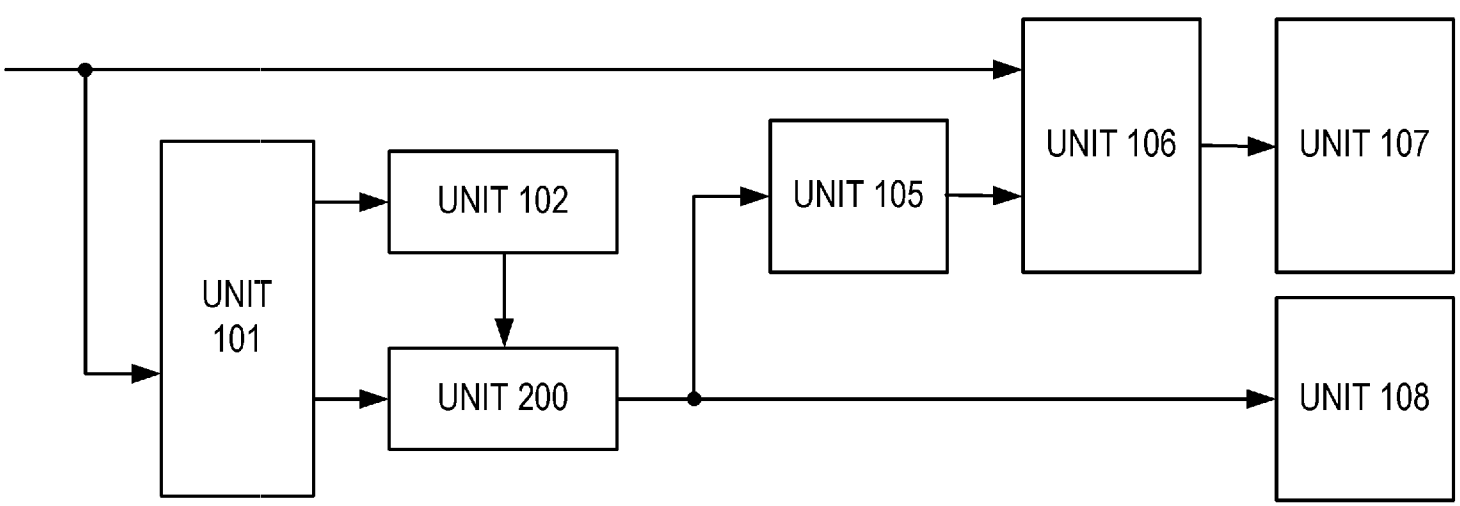
FIG. 16 shows an example of a function configuration of a display apparatus according to a second practical example.

FIG. 16 is a block diagram showing an example of a function configuration of the display apparatus according to the present practical example. The display apparatus according to the present practical example has a backlight control value decision unit 103 of the first practical example and a backlight control value decision unit 200 in place of the backlight control value correction unit 104.

The backlight control value decision unit 200 determines light emission brightness for respective division regions on the basis of determination results of a small area and high brightness region determination unit 102 and characteristic values detected by a characteristic value detection unit 101.

Since other functional units are similar to those of the first practical example, redundant description thereof will not be repeated.

Figure 17:
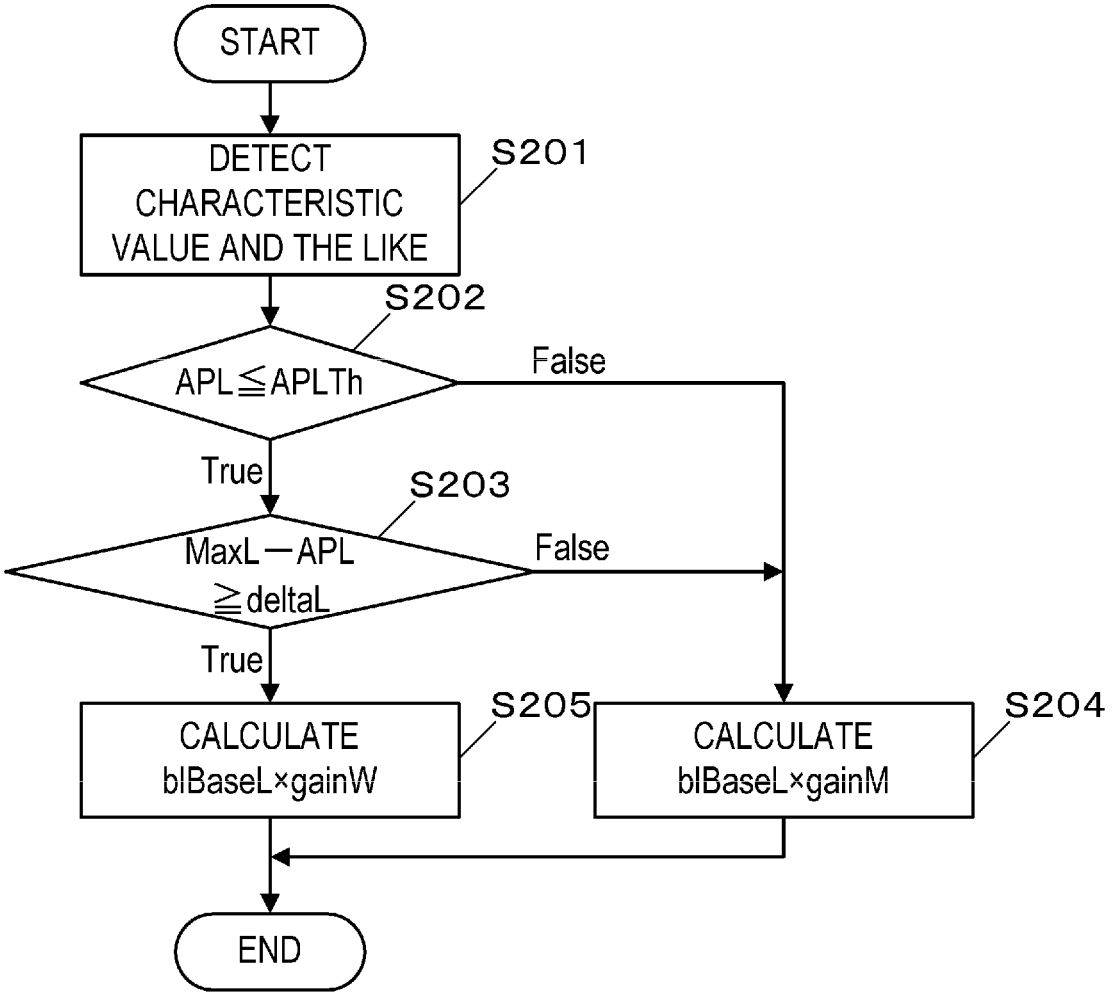
FIG. 17 shows an example of a processing flow of the display apparatus according to the second practical example.

A processing flow of the display apparatus according to the present practical example will be hereinafter described with reference to a flowchart of FIG. 17. FIG. 17 is a flowchart showing an example of the processing flow of the display apparatus according to the present practical example. The flowchart of FIG. 17 is performed repeatedly (or in a parallel manner) for the respective division regions.

First, the characteristic value detection unit 101 detects, from an input image, a characteristic value (maximum pixel value), an average pixel value, and a bright portion area ratio of a division region to be processed (target division region) (S201).

Next, the small area and high brightness region determination unit 102 determines whether or not an average pixel value APL of the target division region is a threshold value APLTh or less (S202). In a case where the average pixel value APL of the target division region is the threshold value APLTh or less (S202: True), the process advances to S203. In a case where the average pixel value APL of the target division region is greater than the threshold value APLTh (S202: False), it is determined that the image displayed in the target division region does not include a small area and high brightness region, and the process advances to S204.

In S203, the small area and high brightness region determination unit 102 determines whether or not a value obtained by deducting the average pixel value APL from a maximum pixel value MaxL of the target division region is a threshold value detlaL or more. In a case where MaxL−APL≥detlaL does not hold (S203: False), it is determined that the image displayed in the target division region does not include the small area and high brightness region, and the process advances to S204. In a case where MaxL−APL≥detlaL holds (S203: True), it is determined that the image displayed in the target division region includes the small area and high brightness region, the process advances to S205.

In S204, the backlight control value decision unit 200 calculates a backlight control value by multiplying a reference value blBaseL of the backlight control value by a gain value gainM corresponding to the characteristic value of the target division region.

In S205, the backlight control value decision unit 200 calculates a backlight control value by multiplying a reference value blBaseL of the backlight control value by a gain value gainW corresponding to a bright portion area ratio Wb of the target division region. In S205, a value, which is smaller than a value obtained in a case of using the gain value gainM, is obtained by using the gain value gainW.

According to the present practical example, similarly to the first practical example, the light emission brightness of the division region determined as not including the small area and high brightness region is light emission brightness according to the characteristic value of the division region. Then, the light emission brightness of the division region determined as including the small area and high brightness region is light emission brightness lower than the light emission brightness according to the characteristic value of the division region. Consequently, it is possible to suppress lowering of brightness of a whole screen and occurrence of misadjusted black levels in the di splay apparatus attaining improvement of contrast of the displayed image by controlling the light emission brightness of the backlight for the respective division regions.

Third Practical Example

Hereinafter, a display apparatus according to a third practical example of the present invention and a control method of the same will be described.

A function configuration of the display apparatus according to the present practical example is similar to that of the second practical example. However, in the present practical example, a region with a small area configuring from pixels with pixel values equal to or greater than a predetermined value is defined as a small area and high brightness region.

Figure 18:
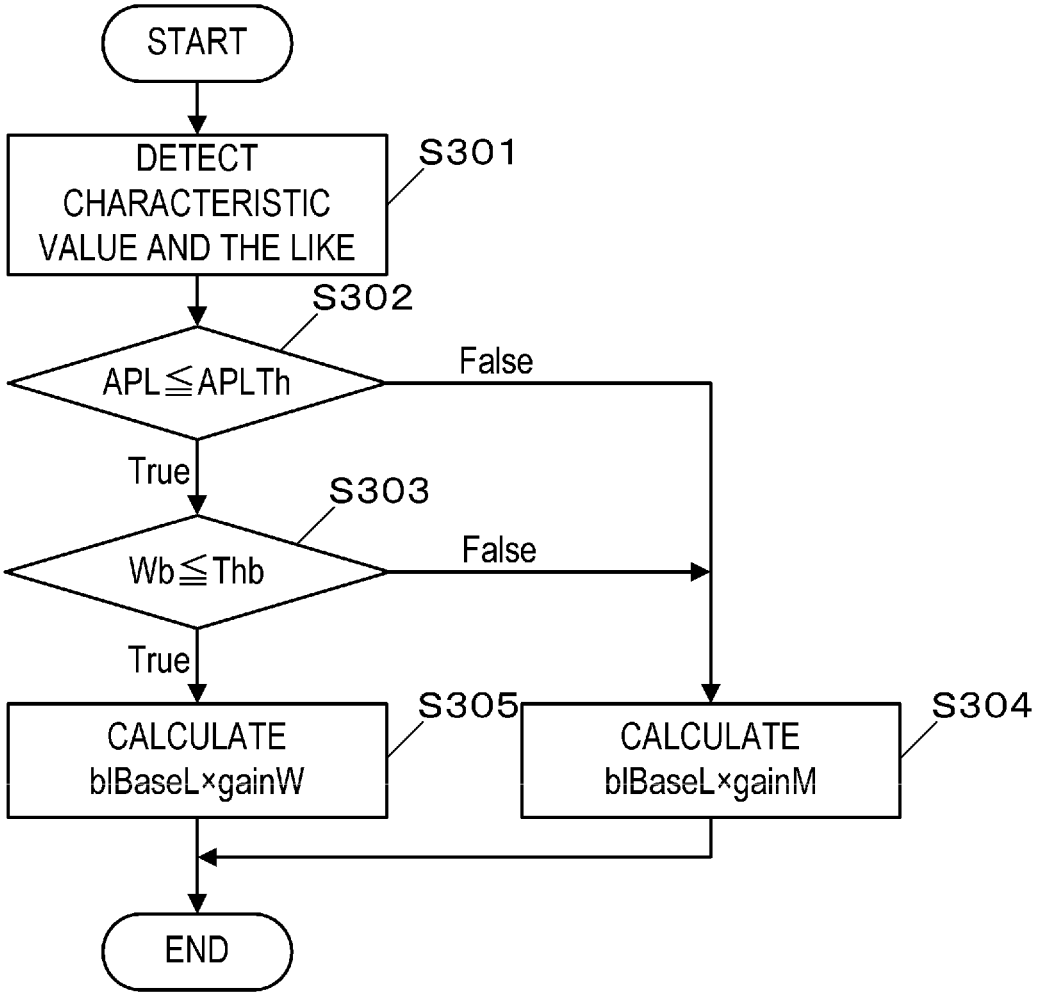
FIG. 18 shows an example of a processing flow of the display apparatus according to a third practical example.

A processing flow of the display apparatus according to the present practical example will be hereinafter described with reference to a flowchart of FIG. 18. FIG. 18 is a flowchart showing an example of the processing flow of the display apparatus according to the present practical example. The flowchart of FIG. 18 is performed repeatedly (or in a parallel manner) for the respective division regions.

First, a characteristic value detection unit 101 detects, from an input image, a characteristic value (maximum pixel value), an average pixel value, and a bright portion area ratio of a division region to be processed (target division region) (S301).

Next, the small area and high brightness region determination unit 102 determines whether or not an average pixel value APL of the target division region is a threshold value APLTh or less (S302). In a case where the average pixel value APL of the target division region is the threshold value APLTh or less (S302: True), the process advances to S303. In a case where the average pixel value APL of the target division region is greater than the threshold value APLTh (S302: False), it is determined that the image displayed in the target division region does not include the small area and high brightness region, and the process advances to S304.

In S303, the small area and high brightness region determination unit 102 determines whether or not a bright portion area ratio Wb (ratio of pixels with pixel values equal to or greater than a predetermined value to total pixels in the image) is a threshold value Thb or less. In a case where the bright portion area ratio Wb of the target division region is greater than the threshold value Thb (S303: False), the small area and high brightness region determination unit 102 determines that the image displayed in the target division region does not include the small area and high brightness region. Then, the process advances to S304. In a case where the bright portion area ratio Wb of the target division region is the threshold value Thb or less (S303: True), the small area and high brightness region determination unit 102 determines that the image displayed in the target division region includes the small area and high brightness region. Then, the process advances to S305.

In S304, a backlight control value decision unit 200 calculates a backlight control value by multiplying a reference value blBaseL of the backlight control value by a gain value gainM corresponding to the characteristic value of the target division region.

In S305, the backlight control value decision unit 200 calculates a backlight control value by multiplying a reference value blBaseL of the backlight control value by a gain value gainW corresponding to the bright portion area ratio Wb of the target division region. In S305, a value, which is smaller than a value obtained in a case of using the gain value gainM, is obtained by using the gain value gainW.

According to the present practical example, similarly to the second practical example, the light emission brightness of the division region determined as not including the small area and high brightness region is light emission brightness according to the characteristic value of the division region. Then, the light emission brightness of the division region determined as including the small area and high brightness region is light emission brightness lower than the light emission brightness according to the characteristic value of the division region. Consequently, it is possible to suppress lowering of brightness of a whole screen and occurrence of misadjusted black levels in the display apparatus attaining improvement of contrast of the displayed image by controlling the light emission brightness of the backlight for the respective division regions.

In S104 of FIG. 2, the process of S303 of FIG. 18 may be performed.

Fourth Practical Example

Hereinafter, a display apparatus according to a fourth practical example of the present invention and a control method of the same will be described.

In the first to third practical examples, corrected pixel values (values obtained by multiplying the pixel values by elongation rates) are limited to a settable upper limit of the pixel values, in a case where the corrected pixel values are greater than the settable upper limit of the pixel values.

Figure 20A:
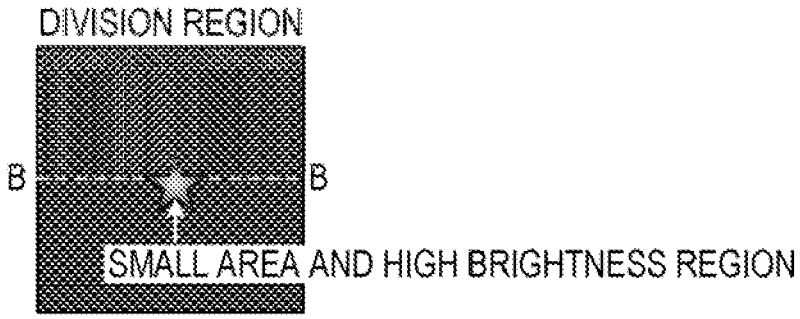
FIGS. 20A to 20D show examples of an image in the division region and distribution of pixel values in the image.
Figure 20B:
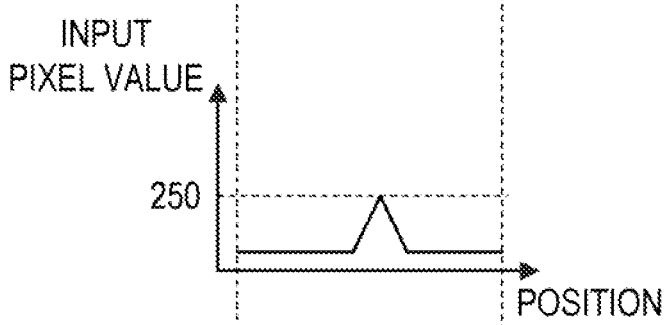
Figure 20C:
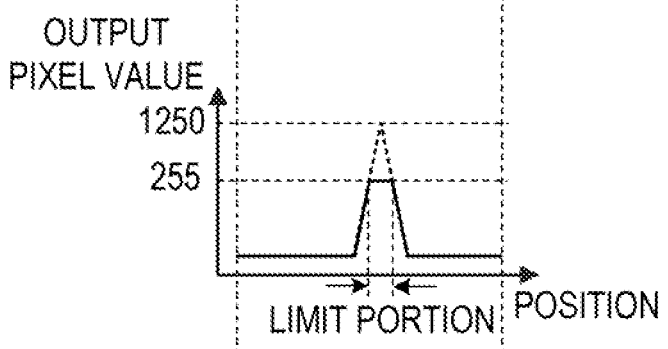
Figure 21:
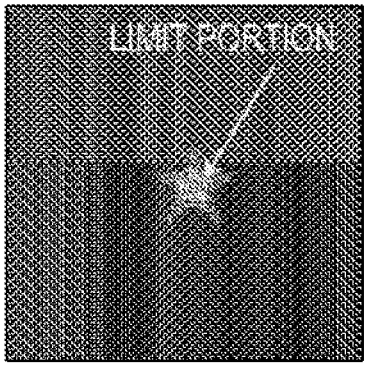
FIG. 21 shows an example of an image with a feeling of strangeness.

Therefore, pixel values of a lot of pixels in the small area and high brightness region are limited to the upper limit value, and an image with a feeling of strangeness may be displayed. FIG. 20A is an enlarged view of a division region A (1, 0) of FIG. 4. FIG. 20B shows distribution of pixel values before elongation on a broken line B-B of FIG. 20A. Assuming that an elongation rate in the division region A is 5 (times), the distribution of the pixel values after elongation in the division region A is distribution shown in a dotted line in FIG. 20C. However, a part of the distribution shown by a dotted line exceeds 255, which is an upper limit value of 8 bits. Therefore, the part of the pixel values is limited to 255, and the distribution of the pixel values is distribution shown by a solid line in FIG. 20C. Specifically, a lot of pixel values in the small area and high brightness region (star portion) are limited to the upper limit value, and an image with a feeling of strangeness is displayed as shown in FIG. 21.

In the present practical example, an example of suppressing the display of an image with a feeling of strangeness by controlling elongation rates such that corrected pixel values do not exceed an upper limit value will be described.

Figure 19:
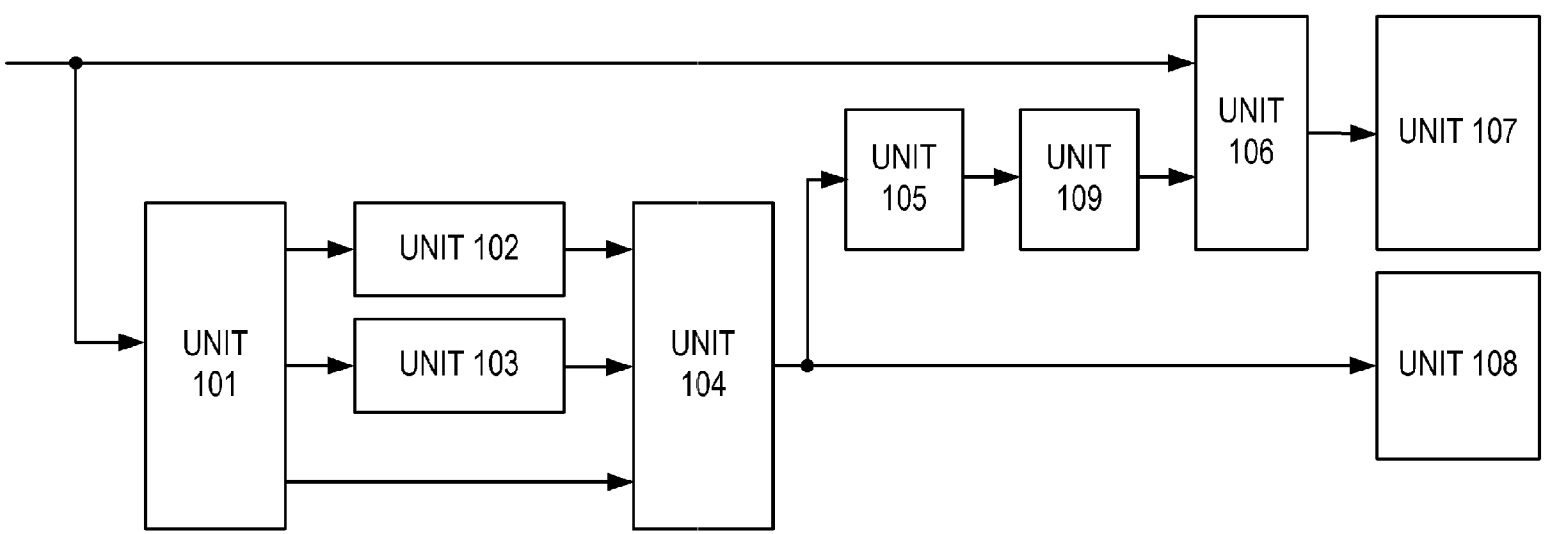
FIG. 19 shows an example of a function configuration of a display apparatus according to a fourth practical example.

FIG. 19 shows an example of a function configuration of a display apparatus according to the present practical example. The display apparatus according to the present practical example further has an elongation rate limit unit 109 in addition to the configuration of the first practical example (FIG. 1). The elongation rate limit unit 109 may be added to the configuration of each of the second and third practical examples (FIG. 16).

The elongation rate limit unit 109 decides elongation rates such that pixel values after multiplication by the elongation rates are not greater than a settable upper limit of pixel values. Specifically, the elongation rate limit unit 109 calculates a limit value of the elongation rates (elongation rates converting maximum pixel values to the upper limit value) from inverses of the maximum pixel values of division regions for the respective division regions. Then, the elongation rates decided by the elongation rate decision unit 105 are replaced by limit values in a case where the elongation rates are greater than the limit values.

As shown in FIG. 5, the maximum pixel value of the division region A is 250. Additionally, the upper limit value of the pixel value is 255. Therefore, the limit value (limit value of the elongation rate) of the division region A is 1.02 (=255/250). Then, the elongation rate decided by the elongation rate decision unit 105 is 5, and hence 1.02 is a final elongation rate.

Figure 20D:
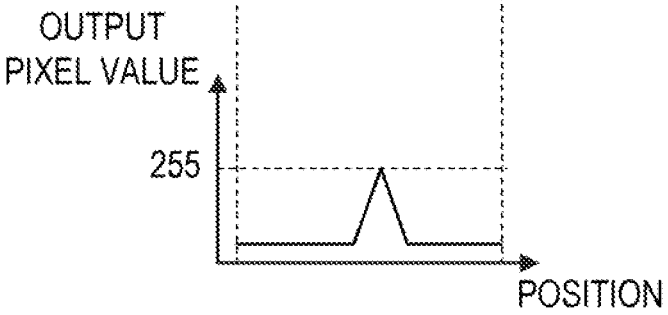
Figure 22:
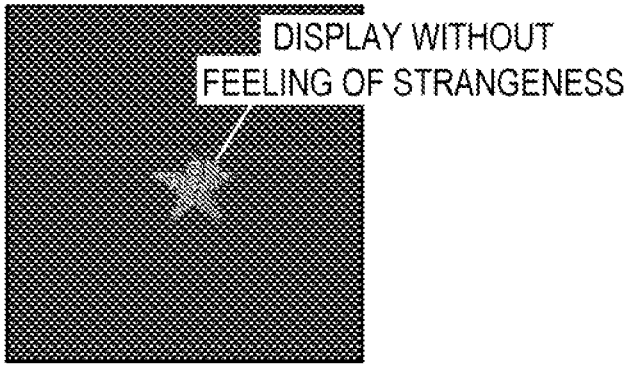
FIG. 22 shows an example of an image displayed by the display apparatus according to the fourth practical example.

As a result, the distribution of pixel values after elongation in the division region A is distribution shown by a solid line of FIG. 20D (the maximum pixel value is made 255 while maintaining the shape of the distribution of FIG. 20B). The respective pixel values are elongated such that the maximum pixel values are made 255 while maintaining the shape of the distribution in FIG. 20B, and hence an image without a feeling of strangeness can be displayed as shown in FIG. 22, and reduction of brightness can be suppressed.

As described above, according to the present practical example, the elongation rates are decided such that the pixel values after multiplication by the elongation rates are not greater than the settable upper limit of the pixel values. Consequently, a region with a feeling of strangeness can be inhibited from occurring on a bright portion of an image.

In the present practical example, the limit value of the elongation rate is not limited to the elongation rate converting the maximum pixel values to the upper limit value. As long as the limit value is such an elongation rate that the pixel value after multiplication by the elongation rate is not greater than the settable upper limit of the pixel values, the limit value may be any elongation rate. That is, the limit value may be smaller than the elongation rate converting the maximum pixel values to the upper limit value.

In a case where the number of the pixels with the corrected pixel values greater than the upper limit value is few, a feeling of strangeness of an image is less (difficult to visually recognize). Therefore, in such a case, elongation rates decided by the elongation rate decision unit 105 may be used. That is, in a case where the number of the pixels with the corrected pixel values greater than the upper limit value is few, the elongation rates may not be replaced by the limit value.

While the elongation rates are replaced by the limit values with respect to all pixels in the division regions in the present practical example, the present invention is not limited to this configuration. For example, regions having large effects obtained by the replacement may be detected, and the elongation rates may be replaced only with respect to pixels in the detected regions. For example, the elongation rate limit unit 109 may detect regions, which are configured from pixels with elongation rates equal to or greater than the limit values, and have the number of pixels equal to or greater than a threshold value, as the regions having the large effects obtained by the replacement, and the elongation rates may be replaced only with respect to pixels in the detected regions. With such a configuration, in a case where the elongation rates are set for respective pixels and the elongation rates are replaced for the respective pixels, processing time can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-088329, filed on Apr. 9, 2012, which is hereby incorporated by reference herein in its entirety.

What is claimed is:

1. A display apparatus comprising:

an acquisition unit that acquires, for each of division regions constituting a region of a screen, brightness information including a maximum pixel value and an average pixel value of an image displayed in the corresponding division region;

a first determination unit that determines, for each of the division regions, whether the corresponding division region is a division region including a predetermined region, on the basis of the brightness information acquired by the acquisition unit;

a second determination unit that determines light emission brightness for each of the division regions on the basis of the brightness information acquired by the acquisition unit and the determination result by the first determination unit;

a light emitting unit that emits, for each of the division regions, light at the light emission brightness of the corresponding division region determined by the second determination unit; and a display panel that displays an image by transmitting the light from the light emitting unit at transmittance based on an input image data, wherein the first determination unit determines that a division region, of which the average pixel value is greater than a first threshold value, and a division region, in which a value obtained by deducting the average pixel value from the maximum pixel value is smaller than a second threshold value, is a division region not including the predetermined region, and determines that a division region, of which the average pixel value is not greater than the first threshold value and in which the value obtained by deducting the average pixel value from the maximum pixel value is not smaller than the second threshold value, is the division region including the predetermined region, and the second determination unit sets light emission brightness of the division region not including the predetermined region, at light emission brightness according to the maximum pixel value of the division region, and sets light emission brightness of the division region including the predetermined region at light emission brightness lower than the light emission brightness according to the maximum pixel value of the division region.

2. The display apparatus according to claim 1, wherein the second determination unit obtains light emission brightness of the division region including the predetermined region according to the maximum pixel value of the division region, and thereafter corrects the light emission brightness by reducing a value thereof.

3. The display apparatus according to claim 1, wherein the second determination unit determines light emission brightness of the division region including the predetermined region such that a difference between the light emission brightness of the division region, and light emission brightness according to the maximum pixel value of the division region, when the predetermined region has a small area, is greater than when the predetermined region has a large area.

4. The display apparatus according to claim 1, wherein the second determination unit determines light emission brightness of the division region including the predetermined region such that a difference between the light emission brightness of the division region, and light emission brightness according to the maximum pixel value of the division region, when the average pixel value of the division region is small, is greater than when the average pixel value is large.

5. The display apparatus according to claim 1, wherein the second determination unit determines light emission brightness of the region including the predetermined region by reducing light emission brightness according to the maximum pixel value of the division region at a predetermined rate.

6. The display apparatus according to claim 1, wherein the second determination unit determines the light emission brightness for each of the division regions by correcting light emission brightness obtained on the basis of the brightness information for each of the division region so as to reduce variation in the light emission brightness.

7. The display apparatus according to claim 1, further comprising:

an image correction unit that suppresses reduction in brightness of the screen due to reduction in light emission brightness by determining, for each of the division regions, an elongation rate on the basis of light emission brightness determined with respect to the corresponding division region, and multiplying each of pixel values of an image displayed in the division region by the determined elongation rate, wherein the image correction unit determines the elongation rate such that pixel values after multiplication by the elongation rate are not greater than a settable upper limit of the pixel values.

8. A control method of a display apparatus having a light emitting unit, and a display panel that displays an image by transmitting light from the light emitting unit at transmittance based on an input image data, the control method of a display apparatus comprising:

an acquisition step of acquiring, for each of division regions constituting a region of a screen, brightness information including a maximum pixel value and an average pixel value of an image displayed in the corresponding division region;

a first determination step of determining, for each of division regions, whether the corresponding division region is a division region including a predetermined region, on the basis of the brightness information acquired by the acquisition step;

a second determination step of determining light emission brightness for each of the division regions on the basis of the brightness information acquired by the acquisition step and the determination result by the first determination step; and a controlling step of controlling the light emitting unit so that the light emitting unit emits, for each of the division regions, light at the light emission brightness of the corresponding division region determined by the second determination step, wherein in the first determination step, it is determined that a division region, of which the average pixel value is greater than a first threshold value, and a division region, in which a value obtained by deducting the average pixel value from the maximum pixel value is smaller than a second threshold value, is a division region not including the predetermined region, and is determined that a division region, of which the average pixel value is not greater than the first threshold value and in which the value obtained by deducting the average pixel value from the maximum pixel value is not smaller than the second threshold value, is the division region including the predetermined region, and in the second determination step, light emission brightness of the division region not including the predetermined region is set at light emission brightness according to the maximum pixel value of the division region, and light emission brightness of the division region including the predetermined region is set at light emission brightness lower than the light emission brightness according to the maximum pixel value of the division region.

9. A display apparatus comprising:

an acquisition unit that acquires, for each of division regions constituting a region of a screen, brightness information of an image displayed in the corresponding division region;

a first determination unit that determines, for each of division regions, whether the corresponding division region is a division region including a predetermined region, on the basis of the brightness information acquired by the acquisition unit;

a second determination unit that determines light emission brightness for each of the division regions on the basis of the brightness information acquired by the acquisition unit and the determination result by the first determination unit;

a light emitting unit that emits, for each of the division regions, light at the light emission brightness of the corresponding division region determined by the second determination unit; and a display panel that displays an image by transmitting the light from the light emitting unit at transmittance based on an input image data, wherein the first determination unit determines that a division region, of which an average pixel value is greater than a first threshold value, and a division region, in which a ratio of pixels with pixel values not smaller than a predetermined value to all pixels is greater than a third threshold value, is a division region not including the predetermined region, and determines that a division region, of which an average pixel value is not greater than the first threshold value and in which the ratio of pixels with pixel values not smaller than a predetermined value to all pixels is not greater than the third threshold value, is the division region including the predetermined region, and the second determination unit sets light emission brightness of the division region not including the predetermined region at light emission brightness according to a maximum pixel value of the division region, and sets light emission brightness of the division region including the predetermined region at light emission brightness lower than the light emission brightness according to a maximum pixel value of the division region.

10. The display apparatus according to claim 9, wherein the second determination unit obtains light emission brightness of the division region including the predetermined region according to the maximum pixel value of the division region, and thereafter corrects the light emission brightness by reducing a value thereof.

11. The display apparatus according to claim 9, wherein the second determination unit determines light emission brightness of the division region including the predetermined region such that a difference between the light emission brightness of the division region, and light emission brightness according to the maximum pixel value of the division region, when the predetermined region has a small area, is greater than when the predetermined region has a large area.

12. A control method of a display apparatus having a light emitting unit, and a display panel that displays an image by transmitting light from the light emitting unit at transmittance based on an input image data, the control method of a display apparatus comprising:

an acquisition step of acquiring, for each of division regions constituting a region of a screen, brightness information of an image displayed in the corresponding division region;

a first determination step of determining, for each of division regions, whether the corresponding division region is a division region including a predetermined region, on the basis of the brightness information acquired by the acquisition step;

a second determination step of determining light emission brightness for each of the division regions on the basis of the brightness information acquired by the acquisition step and the determination result by the first determination step; and a controlling step of controlling the light emitting unit so that the light emitting unit emits, for each of the division regions, light at the light emission brightness of the corresponding division region determined by the second determination step, wherein in the first determination step, it is determined that a division region, of which an average pixel value is greater than a first threshold value, and a division region, in which a ratio of pixels with pixel values not smaller than a predetermined value to all pixels is greater than a third threshold value, is a division region not including the predetermined region, and is determined that a division region, of which an average pixel value is not greater than the first threshold value and in which a ratio of pixels with pixel values not smaller than a predetermined value to all pixels is greater than a third threshold value, is the division region including the predetermined region, and in the second determination step, light emission brightness of the division region not including the predetermined region is set at light emission brightness according to a maximum pixel value of the division region, and light emission brightness of the division region including the predetermined region is set at light emission brightness lower than the light emission brightness according to a maximum pixel value of the division region.

13. A display apparatus comprising:

an acquisition unit that acquires, for each of division regions constituting a region of a screen, brightness information including a maximum pixel value and an average pixel value of an image displayed in the corresponding division region;

a first determination unit that determines, for each of the division regions, whether the corresponding division region meets a condition that the average pixel value is not greater than a first threshold value and a difference between the maximum pixel value and the average pixel value is not smaller than a second threshold value;

a second determination unit that determines light emission brightness of the division region which does not meet the condition at light emission brightness according to the maximum pixel value of the division region, and determines light emission brightness of the division region which meets the condition at light emission brightness lower than the light emission brightness according to the maximum pixel value of the division region;

a light emitting unit that emits, for each of the division regions, light at the light emission brightness of the corresponding division region determined by the second determination unit; and a display panel that displays an image by transmitting the light from the light emitting unit at transmittance based on an input image data.

14. The display apparatus according to claim 13, wherein the second determination unit obtains light emission brightness of the division region which meets the condition according to the maximum pixel value of the division region, and thereafter corrects the light emission brightness by reducing a value thereof.

15. The display apparatus according to claim 13, wherein the first determination unit determines that the division region which meets the condition is the division region including a predetermined region the second determination unit determines light emission brightness of the division region including the predetermined region such that a difference between the light emission brightness of the division region, and light emission brightness according to the maximum pixel value of the division region, when the predetermined region has a small area, is greater than when the predetermined region has a large area.

16. The display apparatus according to claim 13, wherein the second determination unit determines light emission brightness of the division region which meets the condition such that a difference between the light emission brightness of the division region, and light emission brightness according to the maximum pixel value of the division region, when the average pixel value of the division region is small, is greater than when the average pixel value is large.

17. The display apparatus according to claim 13, wherein the second determination unit determines light emission brightness of the region which meets the condition by reducing light emission brightness according to the maximum pixel value of the division region at a predetermined rate.

18. The display apparatus according to claim 13, wherein the second determination unit determines the light emission brightness for each of the division regions by correcting light emission brightness obtained on the basis of the brightness information for each of the division region so as to reduce variation in the light emission brightness.

19. The display apparatus according to claim 13, further comprising:

an image correction unit that suppresses reduction in brightness of the screen due to reduction in light emission brightness by determining, for each of the division regions, an elongation rate on the basis of light emission brightness determined with respect to the corresponding division region, and multiplying each of pixel values of an image displayed in the division region by the determined elongation rate, wherein the image correction unit determines the elongation rate such that pixel values after multiplication by the elongation rate are not greater than a settable upper limit of the pixel values.

20. A control method of a display apparatus having a light emitting unit, and a display panel that displays an image by transmitting light from the light emitting unit at transmittance based on an input image data, the control method of a display apparatus comprising:

an acquisition step of acquiring, for each of division regions constituting a region of a screen, brightness information including a maximum pixel value and an average pixel value of an image displayed in the corresponding division region;

a first determination step of determining, for each of division regions, whether the corresponding division region meets a condition that the average pixel value is not greater than a first threshold value and a difference between the maximum pixel value and the average pixel value is not smaller than a second threshold value;

a second determination step of determining light emission brightness of the division region which does not meet the condition at light emission brightness according to the maximum pixel value of the division region, and determining light emission brightness of the division region which meets the condition at light emission brightness lower than the light emission brightness according to the maximum pixel value of the division region; and a controlling step of controlling the light emitting unit so that the light emitting unit emits, for each of the division regions, light at the light emission brightness of the corresponding division region determined by the second determination step.

* * * * *